US006695631B2

(12) United States Patent
Hamai et al.

(10) Patent No.: US 6,695,631 B2
(45) Date of Patent: Feb. 24, 2004

(54) CONNECTOR ASSEMBLY

(75) Inventors: Tsuyoshi Hamai, Shizuoka-ken (JP); Toshiharu Kudo, Shizuoka-ken (JP); Tomohiko Kimura, Shizuoka-ken (JP); Masahiro Kanda, Shizuoka-ken (JP); Masanori Kikuchi, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/131,130

(22) Filed: Apr. 25, 2002

(65) Prior Publication Data

US 2002/0160638 A1 Oct. 31, 2002

(30) Foreign Application Priority Data

Apr. 27, 2001 (JP) ..... P 2001-133182

(51) Int. Cl.[7] ..... H01R 13/62
(52) U.S. Cl. ..... 439/157; 439/372
(58) Field of Search ..... 439/157, 680, 439/152–160, 342

(56) References Cited

U.S. PATENT DOCUMENTS 5,709,560 A * 1/1998 Hio ..... 439/157

FOREIGN PATENT DOCUMENTS

JP 10-214653 8/1998

* cited by examiner

*Primary Examiner*—Alexander Gilman
(74) *Attorney, Agent, or Firm*—Finnegan, Henderson, Farabow, Garrett & Dunner, L.L.P.

(57) ABSTRACT

Connector assembly (2, 3) includes internal and external connector housings (7, 15) matable with each other. The assembly includes a cam projection (3A) provided to one of the internal and external connector housings. The assembly includes a lever (8) provided rotatably to another one of the internal and external connector housings. The lever defines a cam channel (13) for guiding the cam projection therein to mate the internal and external connector housings with each other. The assembly includes a false-assembly preventing structure (3Ba, 3Bb S1, S2) operative to prevent false-assembly of the internal and external connector housings at an initial mating. The lever is rotatable to push the cam projection to space the internal and external connector housings off.

13 Claims, 5 Drawing Sheets

CONNECTOR ASSEMBLY

BACKGROUND OF THE INVENTION

The invention relates to a connector assembly with a structure for prevention of false-assembly, and more specifically, to a lever-locking one.

A conventional lever-locking connector assembly includes internal and external connectors. An internal connector includes an internal connector housing. The housing is formed longitudinally with terminal accommodation chambers. The internal housing is formed transversely with guide protrusions on the both side faces. The chambers include internal terminal fixtures to be inserted and retained.

An external connector includes an angular tube shaped external connector housing to be mated with the internal connector. The external housing includes external terminal fixtures to be inserted and retained. The external housing has both front edges, which are formed with guide cut-outs rearwardly at a length. Inserted into the cut-outs are the guide protrusions, when the internal and external connectors are mated with each other. The external housing has both side walls which include protruding fulcrums. The fulcrums support rotatably the lever.

SUMMARY OF THE INVENTION

The present invention is directed to a connector assembly with a structure for prevention of false-assembly, which allows prevention of a lever from damage, when connectors are falsely assembled in position.

A first aspect of the invention provides a connector assembly. The assembly includes a first connector housing. The assembly includes a second connector housings matable with the first connector housing in first and second angular positions relative to the first connector housing. The assembly includes a locking mechanism operative to fix first and second connector housings each other in the first and second angular positions. The assembly includes a guide structure operative to guide the first and second housings in a first angular position and to allow the locking mechanism to be ineffective in a second angular position.

Preferably, the locking mechanism includes a cam follower mounted to one of the first and second connector housings. The locking mechanism includes a lever member supported rotatably to another one of the first and second connector housings. The lever member defines a cam channel to guide the cam follower therein in the first angular position. The guide structure is operative to space the cam channel and the cam follower from each other in the second angular position.

Preferably, the lever member is rotatable to displace the cam follower to space the first and second connector housings off.

Preferably, the guide structure includes a first guide part provided to one of the first and second connector housings. The guide structure includes a second guide part provided to another one of the first and second connector housings. The second guide part is engagable with the first guide member in the first angular position. The guide structure includes a stopper part provided to one of the first and second connector housings. The stopper part is operative to abut against one of first and second guide parts in the second angular position.

Preferably, one of the first and second guide parts includes a channel. Another one of the first and second guide parts includes a projection insertable into the channel.

Preferably, the cam channel includes an opening with a first radius relative to a fulcrum. The cam follower and the fulcrum have a first distance therebetween greater than the first radius in the second angular position.

Preferably, the lever member includes a displacing part adjacent to the cam channel. The displacing part has an outer periphery with a second radius greater than the first radius relative to the fulcrum.

A second aspect of the invention provides a connector assembly. The assembly includes internal and external connector housings matable with each other. The assembly includes a cam projection provided to one of the internal and external connector housings. The assembly includes a lever provided rotatably to another one of the internal and external connector housings. The lever defines a cam channel for guiding the cam projection therein to mate the internal and external connector housings with each other. The assembly includes a false-assembly preventing structure operative to prevent false-assembly of the internal and external connector housings at an initial mating. The lever is rotatable to push the cam projection to space the internal and external connector housings off.

Preferably, the false-assembly preventing structure includes a projection provided to one of the internal and external connector housings. The structure includes a stopper provided to another one of the internal and external connector housings. The stopper is operative to abut against the projection at the false-assembly. Thus, the lever is rotatable to push the cam projection off.

BRIEF DESCRIPTION OF THE ACCOMPANYING DRAWINGS

These and other features, aspects, and advantage of the present invention will become better under stood with reference to the following description, appended claims, and accompanying drawings where:

DETAILED DESCRIPTION OF THE PREFERRED EMBODIMENTS

An embodiment of the invention will be described with reference to drawings.

Figure 1:
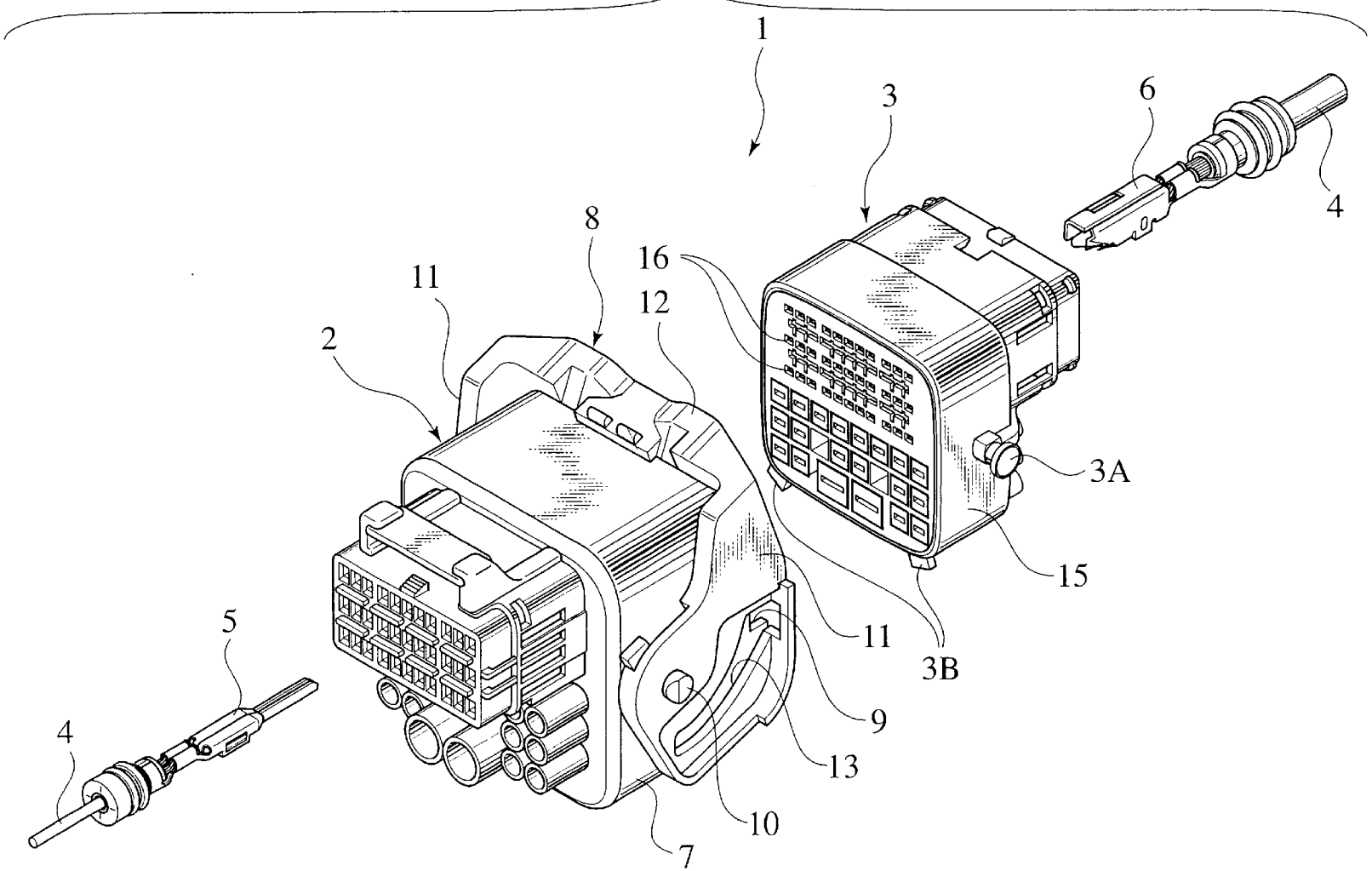
FIG. 1 is an exploded perspective view of an embodiment of a connector with a structure for prevention of false-assembly according to the embodiment of the invention.

As shown in FIG. 1, connector assembly 1 according to the invention includes the structure for prevention of false-assembly. Connector assembly 1 includes external and internal connectors 2, 3 to be mated and electrically joined each other. External and internal connectors 2, 3 have wires 4 mounted thereto. Respective wires 4 include respective terminal ends mounted to respective terminal fixtures 5, 6.

Figure 2:
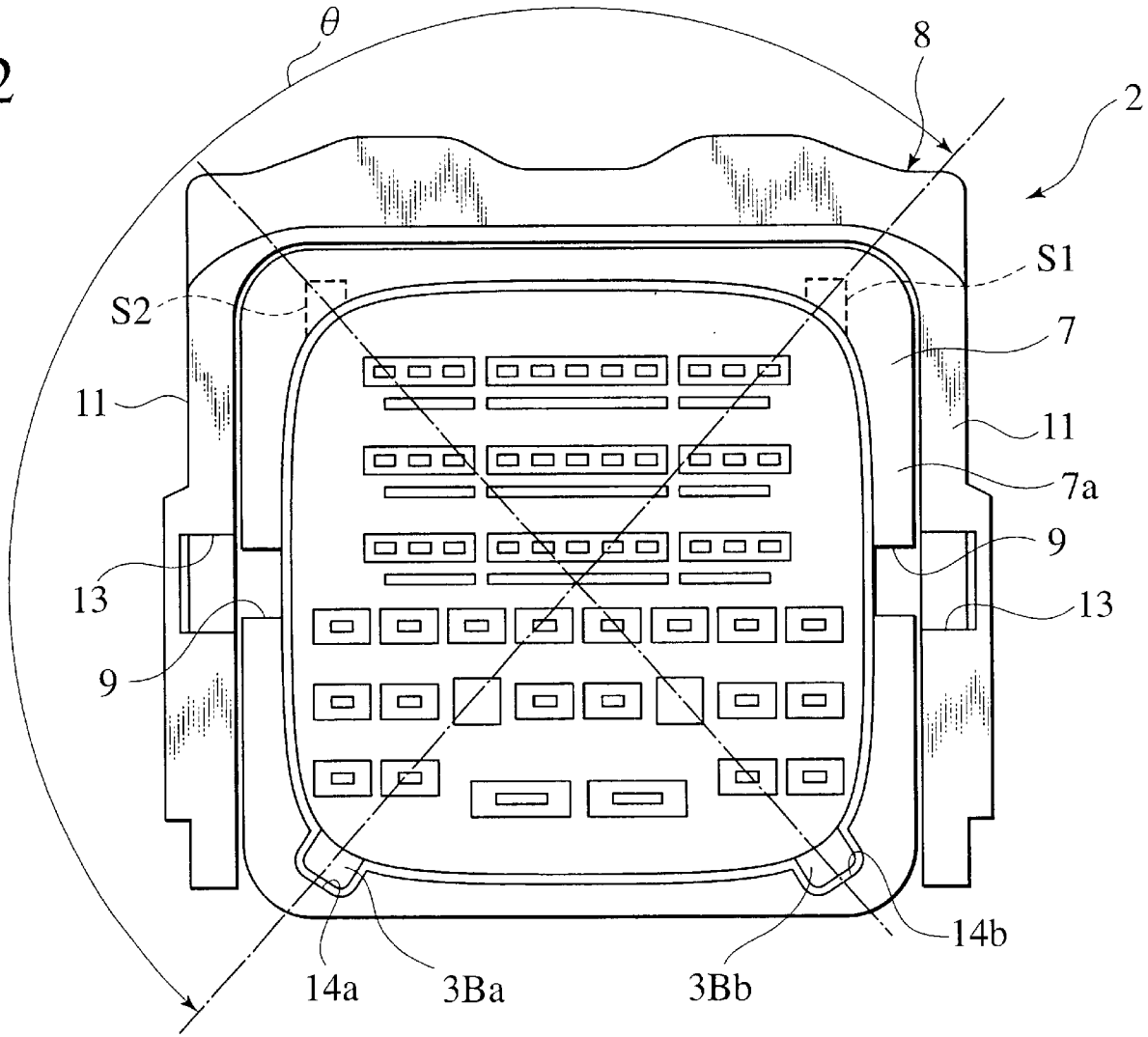
FIG. 2 is an elevation view of the external connector in FIG. 1.

External connector 2, in FIG. 2, includes external connector housing 7. Connector 2 includes lever 8 rotatably supported on housing 7. Housing 7 includes terminal accommodation chambers (not shown on FIGS.) longitudinally therethrough. Each chamber houses fixture 5 connected to the terminal end of wire 4. Fixtures 5 are arranged in parallel to space away at an interval each other.

Housing 7 has both side walls with front edges which define guide cut-outs 9 rearwardly at a predetermined length. Cut-outs 9 have guide protrusions 3A as a cam pin of internal connector 3 as described later, which are inserted when internal and external connectors 2, 3 are mated.

Both side walls of housing 7 each have protruding fulcrum 10, which rotatably supports lever 8. Lever 8 has a pair of arm plates 11 which are disposed along the outer faces of the both side walls. Lever 8 has connection operation part 12 extending between the ends of plates 11 for connection. Plates 11 have fulcrum holes at portions, where fulcrums 10 are rotatably fitted. The fitting of fulcrums 10 into the holes allows the mounting of lever 8. Lever 8 is normally biased by a coil spring 103, shown on FIG. 4, in a certain rotational direction. Plates 11 are formed with cam channels 13. Cam channels 11 lap with cut-outs 9 at the ends. When protrusions 3A of connector 3 are inserted into cut-outs 9 of housing 7, the rotation of lever 8 against coil spring 103 under biasing force allows the introduction of protrusions 3A inwardly into cut-outs 9.

Specifically, according to the embodiment, housing 7 has recesses or channels 14*a*, 14*b* at both sides of the lower part on the front end, which serves as the insertion of ribs or projections 3B (3Ba and 3Bb). Channels 14*a*, 14*b* are disposed in correspondence with projections 3Ba, 3Bb of connector 3 for prevention of false-assembly. Channels 14*a*, 14*b* are recessed on the inner wall of housing 7, extending rearwardly from the front end.

Connector 3, in FIG. 1, has fixtures 6 with wires 4 each inserted into chambers 16 for retention. Fixtures 6 with wires 4 are arranged in parallel to space away at an interval each other.

Housing 15 has both side walls from which guide protrusions 3A protrude. Protrusions 3A are inserted into cut-outs 9 and cam channels 13. Protrusions 3A are each disposed in a vertical central position on the side wall of housing 15, to transmit pulling force from lever 8 uniformly to whole connector 3.

Figure 3:
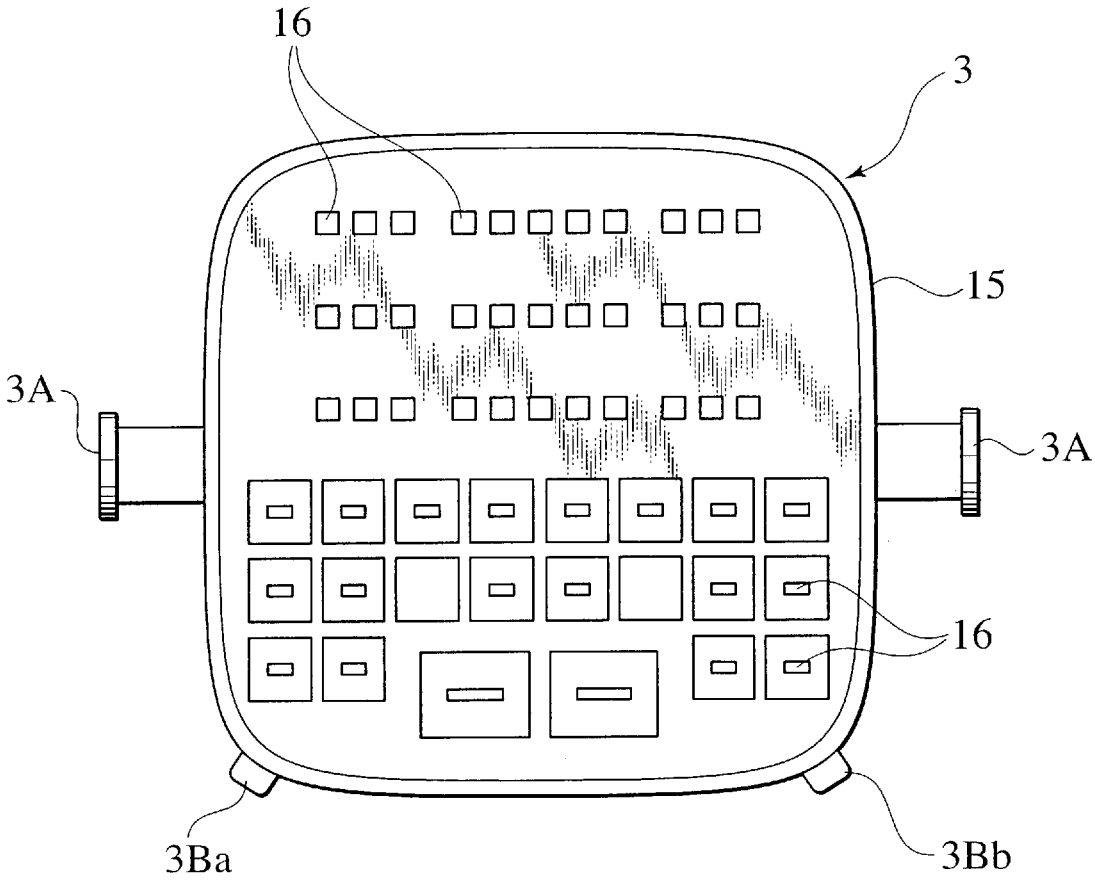
FIG. 3 is an elevation view of an internal connector.

The front end of housing 15, in FIGS. 1 to 3, has outwardly protruding projections 3Ba, 3Bb, which are disposed in correspondence with channels 14*a*, 14*b* of housing 7 in angular position. When connectors 2, 3 are mated correctly with each other, the insertion of respective projections 3Ba, 3Bb into respective channels 14*a*, 14*b* allows the fitting of connector 3 into connector 2. Connector 3 allows to be mated with connector 2 at an angular displacement of 180 degrees from a correct position. When connector 3 is inserted in a vertically reversed position, or is displaced angularly at 180 degrees from the correct position, respective projections 3Ba, 3Bb abut against respective regions S1, S2 of both sides at the upper part of opening on the front end wall 7*a* of housing 7 (stopper region indicated by the dotted line), to prevent the assembly of connectors 2, 3. Regions S1, S2 each include a closed wall at angular displacement of 180 degrees from channels 14*a*, 14*b*, which stops each projection 3A, 3B.

Figure 4:
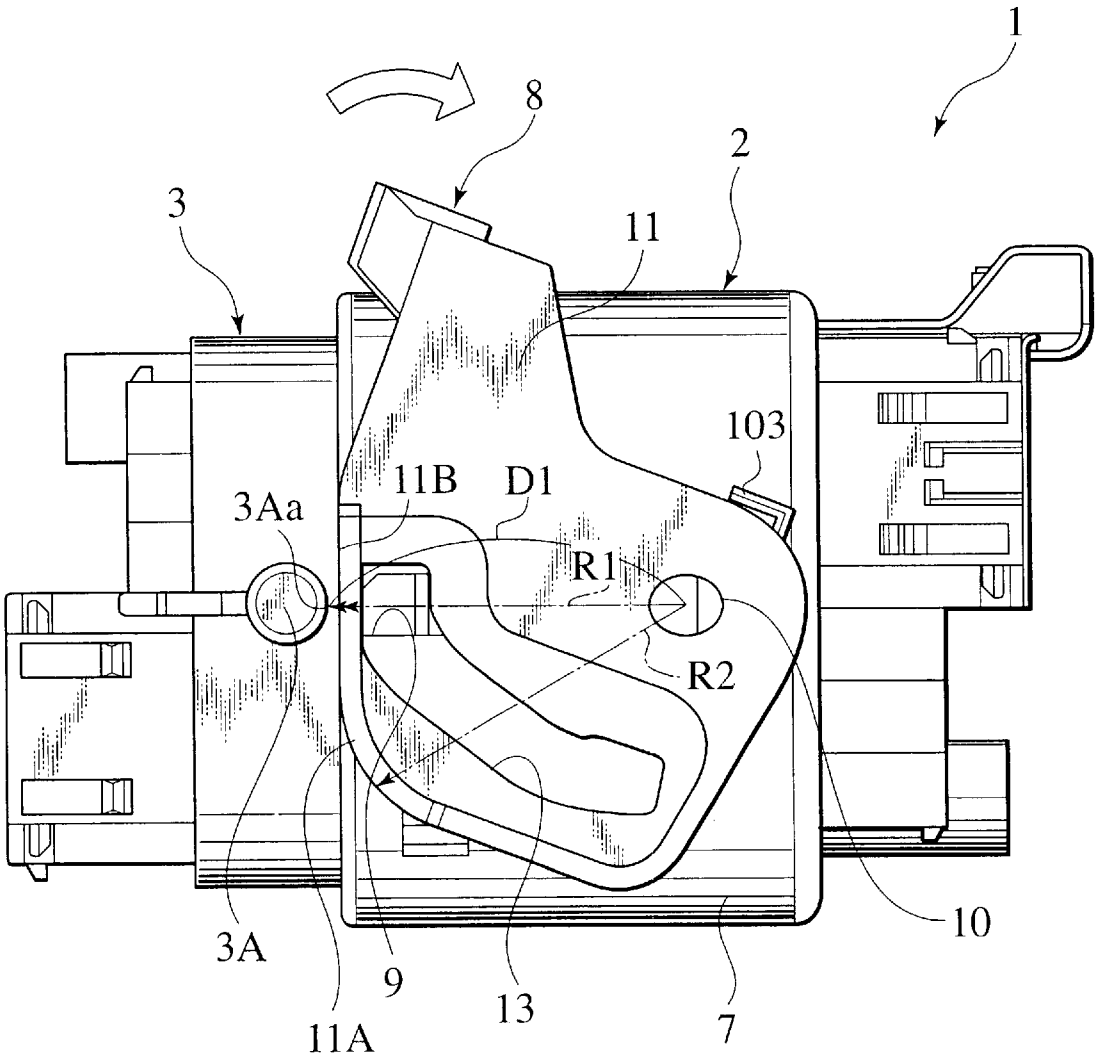
FIG. 4 is a side view illustrating internal and external connectors in false-assembly.

In FIG. 4, protrusion 3A has peripheral face 3Aa away from the center of fulcrum 10 at a relative distance of D1. The openings 11B of cut-outs 9 and channels 13 are away from the center of fulcrum 10 at a radius of R1. R1 is greater than D1. The relative abutting distance between respective projections 3Ba, 3*b* and respective regions S1, S2 is set at D2 identical to the number of subtracting R1 from 2D1 or (2D1-R1).

Inserted into housing 15 is connector 3 in a vertically reversed position. In this state, Both side projections 3Ba, 3Bb of housing 15 abut against stopper regions S1, S2 of end wall 7*a* of housing 7. Protrusions 3A do not enter in the openings 11B of cut-outs 9 and cam channels 13, to be prevented from the insertion at the front position. When an operator rotates falsely lever 8 in the direction indicated by the arrow, lever 8 does not engage with protrusions 3A to be easily rotated.

Figure 5:
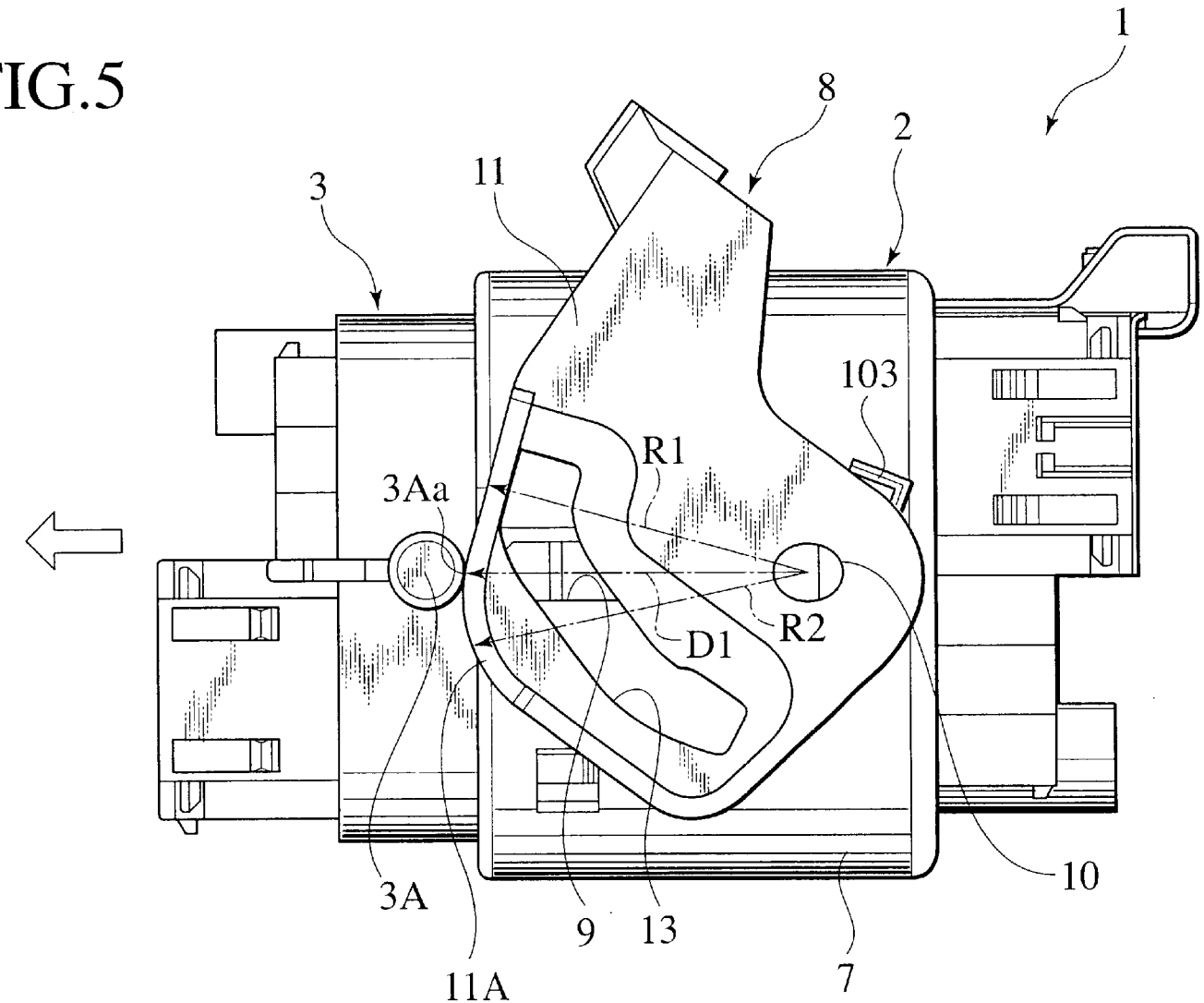
FIG. 5 is a side view illustrating internal and external connectors in false-assembly.

Plates 11 of lever 8 abut against protrusions 3A during the rotation to push protrusion 3A away from connector 2. In order to obtain the operation, plates 11 of lever 8 are formed with bulges 11A to be abutted against protrusions 3A. The plates 11 each have bulge 11A which includes an outer periphery with a maximum radius of R2 greater than R1 relative to fulcrum 10. The pushing of bulges 11A against protrusions 3A allows connector 3 to be pushed away from connector 2 (in the direction indicated by the arrow in FIG. 5) for discharge. The result prevents the false-assembly between connectors 2, 3 and the damage of lever 8 due to the exertion of forced stress on lever 8.

While the preferred embodiment of the present invention have been described using specific terms, such description is for illustrative purposes, and it is to be understood that changes and variations may be made without departing from the spirit or scope of the following claims. For example, connector housing 7 may be inversely formed with the projections for prevention of false-assembly, while connector housing 15 may be formed with the channels for insertion of the projections.

According to the invention, the false-assembly preventing structure prevents an operator from falsely assembling of internal and external connectors in an initial assembly, previously. The false-assembly preventing structure allows rotating lever to push against a cam projection for spacing internal and external connectors off. The spacing allows the internal and external connectors to be easily identified in false-assembly.

The projection of one connector housing abuts against the stopper of another connector housing in false-assembly. The abutment advantageously prevents false-assembly with a simple structure. The stopper allows the lever to push against the cam projection in an initial-assembly. This advantageously prevents the damage of the lever during the rotation.

The entire contents of Japanese Patent Application P2001 -133182 (filed on Apr. 27, 2001) are incorporated herein by reference.

What is claimed is:

1. A connector assembly comprising:

a first connector housing;

a second connector housing being matable with the first connector housing in first and second angular positions relative to the first connector housing;

a locking mechanism being operative to fix the first and second connector housings to each other in the first and second angular positions; and a guide structure being operative to guide the first and second housings in the first angular position and to allow the locking mechanism to be ineffective in the second angular position, the locking mechanism being operative to move the first and second connector housings apart when the first and second connector housings are in the second angular position.

2. The connector assembly according to claim 1, wherein the guide structure comprises:

a first guide part provided to one of the first and second connector housings;

a second guide part provided to another one of the first and second connector housings, the second guide part being engageable with the first guide part in the first angular position; and a stopper part provided to one of the first and second connector housings, the stopper part being operative to abut against one of the first and second guide parts in the second angular position.

3. The connector assembly according to claim 2, wherein one of the first and second guide parts includes a channel, and another one of the first and second guide parts includes a projection insertable into the channel.

4. The connector assembly according to claim 1, wherein the locking mechanism comprises:

a cam follower mounted to one of the first and second connector housings; and a lever member supported rotatably to the other one of the first and second connector housings, the lever member defining a cam channel to guide the cam follower therein in the first angular position, and wherein the guide structure is operative to space the cam channel and the cam follower from each other in the second angular position.

5. The connector assembly according to claim 4, wherein the lever member is rotatable to displace the cam follower to move the first and second connector housings apart when the first and second connector housings are in the second angular position.

6. The connector assembly according to claim 4, wherein the cam channel includes an opening with a first radius relative to a fulcrum, wherein the cam follower and the fulcrum have a first distance therebetween greater than the first radius in the second angular position.

7. The connector assembly according to claim 6, wherein the lever member comprises:

a displacing part adjacent to the cam channel, the displacing part having an outer periphery with a second radius greater than the first radius relative to the fulcrum.

8. A connector assembly comprising:

internal and external connector housings being matable with each other;

a cam projection provided to one of the internal and external connector housings;

a lever provided rotatably to another one of the internal and external connector housings, the lever defining a cam channel for guiding the cam projection therein to mate the internal and external connector housings with each other; and a false-assembly preventing structure operative to prevent false-assembly of the internal and external connector housings at an initial mating, whereby the lever is rotatable to push the cam projection to move the internal and external connector housings apart when the internal and external connector housings are in the second angular position.

9. The connector assembly according to claim 8, wherein the false-assembly preventing structure comprises:

a projection provided to one of the internal and external connector housings; and a stopper provided to the other one of the internal and external connector housings, the stopper being operative to abut against the projection at the false-assembly, whereby the lever is rotatable to move the cam projection away from the cam channel.

10. A connector assembly comprising:

a first connector housing;

a second connector housing being matable with the first connector housing in first and second angular positions relative to the first connector housing;

a locking mechanism being operative to fix the first and second connector housings to each other in the first and second angular positions, the locking mechanism including, a cam follower mounted to one of the first and second connector housings, a lever member supported rotatably to the other one of the first and second connector housings, the lever member defining a cam channel to guide the cam follower therein in the first angular position, the cam channel including an opening with a first radius relative to a fulcrum, the cam follower and the fulcrum having a first distance therebetween greater than the first radius in the second angular position, the lever member including a displacing part adjacent to the cam channel, the displacing part having an outer periphery with a second radius greater than the first radius relative to the fulcrum, a guide structure being operative to guide the first and second housings in the first angular position and to allow the locking mechanism to be ineffective in the second angular position, and wherein the guide structure is operative to space the cam channel and the cam follower from each other in the second angular position.

11. The connector assembly according to claim 10, wherein the lever member is rotatable to displace the cam follower to move the first and second connector housings apart when the first and second connector housings are in the second angular position.

12. The connector assembly according to claim 10, wherein the guide structure comprises:

a first guide part provided to one of the first and second connector housings;

a second guide part provided to another one of the first and second connector housings, the second guide part being engageable with the first guide part in the first angular position; and a stopper part provided to one of the first and second connector housings, the stopper part being operative to abut against one of the first and second guide parts in the second angular position.

13. The connector assembly according to claim 12, wherein one of the first and second guide parts includes a channel, and another one of the first and second guide parts includes a projection insertable into the channel.

* * * * *